US007363686B2

(12) United States Patent
Fukuyasu et al.

(10) Patent No.: US 7,363,686 B2
(45) Date of Patent: Apr. 29, 2008

(54) NON-METALLIC TWIST TIE

(75) Inventors: Masaaki Fukuyasu, Osaka (JP); Yoshinori Kotera, Osaka (JP); Norio Kashihara, Osaka (JP); Tomoji Abe, Osaka (JP)

(73) Assignee: Kyowa Limited, Osaka (JP)

( * ) Notice: Subject to any disclaimer, the term of this patent is extended or adjusted under 35 U.S.C. 154(b) by 0 days.

(21) Appl. No.: 10/574,428

(22) PCT Filed: Oct. 14, 2003

(86) PCT No.: PCT/JP03/13144

§ 371 (c)(1),
(2), (4) Date: Apr. 3, 2006

(87) PCT Pub. No.: WO2005/035381

PCT Pub. Date: Apr. 21, 2005

(65) Prior Publication Data

US 2007/0006426 A1 Jan. 11, 2007

(51) Int. Cl.
*B65D 63/10* (2006.01)
*B65D 77/10* (2006.01)

(52) U.S. Cl. ..... 24/30.5 P; 24/30.5 R; 24/30.5 T

(58) Field of Classification Search ..... 24/16 R, 24/16 PB, 30.5 P, 30.5 R, 30.5 T, 30.5 W; 264/167, 173.16, 177.1; 383/71, 127, 905; 428/99, 156, 167, 172, 402, 480, 516
See application file for complete search history.

(56) References Cited

U.S. PATENT DOCUMENTS 4,525,898 A * 7/1985 Gallion et al. ..... 24/30.5 W
4,797,313 A * 1/1989 Stolk et al. ..... 24/30.5 T
5,154,964 A * 10/1992 Iwai et al. ..... 24/30.5 T
5,238,631 A * 8/1993 Stolk et al. ..... 264/147

(Continued)

FOREIGN PATENT DOCUMENTS

JP S57-34143 7/1982

(Continued)

OTHER PUBLICATIONS

International Search Report for International Application No. PCT/JP03/13144 dated Dec. 2, 2003.

(Continued)

*Primary Examiner*—James Brittain
*Assistant Examiner*—Ruth C. Rodriguez
(74) *Attorney, Agent, or Firm*—Kolisch Hartwell, P.C.

(57) ABSTRACT

The present invention provides a nonmetallic twist tie in which the function inherent to the twist tie is of course available and the twist tie is easily made into a shape of being wound in a bundle with no slipping down of the tie into gap, no torsion of the tie itself, no curl, no twining and tangling of ties and no loosening or disjoining from a reel whereby its drawing-out from the wound shape is able to be carried out smoothly. The nonmetallic twist tie having a core part and a wing part constituted from a non-halogenous material is characterized in that (1) a shape having a total width is 1.5 to 20.0 mm, the average thickness of the wing part is 0.02 to 0.20 mm and the maximum thickness of the core part is 0.04- to 0.30-fold of the total width, (2) a binding property where a torsion strength is 5.0 to 15 N, (3) a rigidity where a tensile elasticity is 5,000 to 30,000 Mpa, (4) a property of forming a fixed shape where the property is 90% or more and a property of retaining a fixed shape where the rate of retaining the fixed shape is 70 to 95%, and (5) a drawing-out property where a degree of curving to the drawing-out direction is 10° or less and a curl radius to the winding direction retains the range of 50 to 200 mm.

5 Claims, 5 Drawing Sheets

U.S. PATENT DOCUMENTS

| | | | | |
|---|---|---|---|---|
| 5,342,687 | A * | 8/1994 | Iwai et al. | 24/30.5 T |
| 5,607,748 | A * | 3/1997 | Feltman | 24/30.5 P |
| 5,827,461 | A * | 10/1998 | Feltman | 264/177.1 |
| 5,989,683 | A * | 11/1999 | Haddock et al. | 24/30.5 T |
| 6,372,068 | B1 * | 4/2002 | Kincel et al. | 156/73.2 |
| 6,673,413 | B1 * | 1/2004 | Kincel et al. | 24/30.5 T |
| 7,011,879 | B1 * | 3/2006 | Contreras et al. | 24/30.5 T |

FOREIGN PATENT DOCUMENTS

| | | |
|---|---|---|
| JP | S60-190654 | 12/1985 |
| JP | 62122965 | 6/1987 |
| JP | 03-124573 | 5/1991 |
| JP | H03-20305 | 5/1991 |
| JP | 11-293577 | 10/1999 |
| JP | 2000-095267 | 4/2000 |
| JP | 2000-118555 | 4/2000 |
| JP | 2000-203624 | 7/2000 |
| JP | 2003-205565 | 7/2003 |

OTHER PUBLICATIONS

Supplementary European Search Report from European Patent Application Serial No. EP 03 75 4110, dated Oct. 17, 2007.

* cited by examiner 1 twist tie
2 wound shape
2 a winding jig (reel)

1 a extrusion tie
3 core part
4 wing part
h maximum thickness of the core part
W total width 1 b lamination tie
5 plastic core material
6 coating material
h maximum thickness of the core part
W total width 1 twist tie
2 winding jig (reel)
11 main body of the binding machine
12 side roll
13 binding groove 1 twist tie
7 thing to be bound
9 bound part 1 twist tie
8 loop part after pulling out from the thing to be bound
9 bound part
10 loop end when loop part was cut 15 thick paper for the measurement of degree of curving α degree of curving 1 twist tie 2 wound shape in a bundle 2 a reel 16 thick paper for the measurement of curl radius γ curl radius

NON-METALLIC TWIST TIE

FIELD OF THE INVENTION

The present invention relates to a nonmetallic twist tie having no core line in the core part or having no wire for a core line in the core part and being able to form into a good wound shape in a bundle. The tie is used for binding a material to be bound using a binding machine mostly in food companies where bread, confectionery, etc. are manufactured or sold, in agricultural garden companies where cut flower, etc. are produced or sold, in electric and electronic instrument companies where electric and electronic products with wiring devices are manufactured or sold, etc.

BACKGROUND ART

In the long-size wound twist tie of such a type, it is necessary that, in its repeatedly wound state onto a reel or the like, there is no slipping down of the tie into reel gap, no torsion and curl, no twining and tangling of ties, no loosening or disjoining from a reel and smooth drawing-out. Accordingly, soft PVC is used as a resin material for a material to be coated, a twist tie using a wire which has a big ability of forming a fixed shape as a core material is wound around a plastic reel or the like and the resulting one is often used in the case of binding a thing to be bound by means of a high-binding number of 50 to 100 bindings per minute.

On the other hand, due to considerations to environment in recent years, there has been a strong demand particularly in food companies, electric/electronic companies, etc. for a product where no wire is used in core material (or core part) and, further, substance of the material used therefor such as coating agent is a non-halogenous material such as an olefin resin.

In order to meet the demand as such, various ties have been proposed by the present applicant already. They are, for example, Japanese Utility Model Laid-Open No. 60/190,654 and Japanese Patent Laid-Open Nos. 11/293,577 and 2000/118,555 for a lamination twist tie using a plastic line as a core material and paper or olefin resin (e.g., PE, PP, PET or PBT) as a coating material; and U.S. Pat. No. 4,797,313, Japanese Patent Nos. 2,520,403and2,813,994, U.S. Pat. No. 5,154,964 and Japanese Patent Laid-Open No. 2000/095,267 for a non-core twist tie of an extrusion type having no core line in the core part where resin such as olefin is used and a wing part is subjected to a united extrusion molding together with the core part.

Thus, in Japanese Utility Model Laid-Open No. 60/190,654, there is a disclosure for a twist tie which is hardly corroded, is able to prevent injury of fingertip, does not cause electric leakage and is able to be used for a metal detector where a synthetic resin line such as polyester is used as a core line and a synthetic resin material such as polyethylene, polypropylene or polyester is used as a coating material.

In Japanese Patent Laid-Open No. 11/293,577, there is a disclosure for a lamination twist tie having a good operation ability for attachment and detachment where a synthetic resin line of polyethylene subjected to an elongating treatment is used as a core line and a plastic film such as a film vapor-deposited with polyester is used as a coating material and a method for manufacturing the same.

In Japanese Patent Laid-Open No. 2000/118,555, there is a disclosure for a lamination twist tie having the characteristics of (1) unpacking and back torsion are easily conducted without returning the bonded part to a loose state, (2) flexibility is available, (3) no projection of the core material is noted, etc. where a plastic line of a multi-filament type is used as a core line and nonwoven fabric, paper or plastic film is used as a coating material.

In U.S. Pat. No. 4,797,313 and Japanese Patent No. 2,520,403, there is a disclosure for a coreless twist tie prepared by means of an extrusion molding having no core line in the core part and, for example, there is a disclosure for a twist tie containing a polymer substance which is a thermoplastic polymer containing at least 50% of polyalkylene terephthalate, styrene-acrylonitrile copolymer, polystyrene and poly(vinyl chloride) having a glass transition temperature of higher than about 30° C., showing a glass/rubber transition behavior at the temperature of about 10 to 30° C. and having the characteristics that (1) it is able to be bound and tied by hand or by a mechanical device, (2) it is able to be bonded/tied, loosened and re-bonded within a wide temperature range and a tight binding is able to be retained, (3) it is able to be used in a microwave oven and (4) it is able to retain a tight binding even under a high-temperature treatment.

In Japanese Patent No. 2,813,994, there is a disclosure for a coreless twist tie using no core line in the core part which is composed of a crystalline thermoplastic synthetic resin such as polyethylene resin, polypropylene resin, polyamide resin, polybutylene terephthalate resin and polyethylene terephthalate resin and glass beads having a particle size of not larger than 60 μ and prepared by elongation where the elongation rate is 2.5-fold or more whereby it is easily twisted and is able to retain its twisted binding state.

In U.S. Pat. No. 5,154,964, there is a disclosure for a ribbon-shaped wireless twist tie having no core line in the core part which is easily twisted and easily loosened. The tie is prepared by elongation, to an extent of 2.5-fold or more, of a polymer resin having a degree of crystallization of 10 to 60% at the crystallization temperature of about 100 to 250° C.

In Japanese Patent Laid-Open No. 2000/095,267, there is a disclosure for a plastic-bound tie having no core line in the core part in which a tensile elasticity load of the convex part playing a role of the core is 100 to 625 kgf while that of the flat part playing a role of a wing is 20 to 120 kgf whereby the load of the former is twice or more of the load of the latter and two incompatible properties of easy deformation versus strong binding property are able to be available at the same time.

In those twist ties in which the core part has no core line or wire is not used for the core line of the core part and the material used for the coating material is constituted from a non-halogenous material such as olefin resin, improvement in their properties is significant and, in the shape being cut in a short size, they fully achieve their function and have been able to be used without problem. On the other hand however, ability of the core part for forming a fixed shape is essentially weaker than wire and, moreover, the coating material has higher hardness than soft PVC as compared with the conventional twist ties where wire is used as a core line and PVC is used as a coating material. Therefore, they are not convenient for a shape of being wound in a bundle like in the case of winding on a reel. Thus, during winding, transportation and actual use, there are resulted slipping down of the tie into gap of a reel, torsion of the tie itself, curl, twining and tangling of the tie and loosening or disjoining from a wound state and, as a result, there are generated many problems such as that a smooth drawing-out is not possible whereby the actual situation is that no completely satisfactory tie has been available yet.

OBJECT OF THE INVENTION

The present invention has been achieved for solving the problems in the prior art as such and its object is to provide a nonmetallic twist tie in which the function inherent to the twist tie is of course available and the twist tie is easily made into a shape of being wound in a bundle whereby its drawing-out from the wound shape is able to be carried out smoothly.

To be more specific, an object of the present invention is to provide a nonmetallic twist tie in a shape of a ribbon in which both core part and wing part are constituted from a non-halogenous material and necessary function inherent to the twist tie such as torsion property and binding property are fully achieved wherein, during forming and retaining its state of being wound in a bundle, there is little occurrence of slipping down of the tie into gap of a reel, torsion and curl of the tie itself, twining and tangling of ties, loosening or disjoining in a wound state and, during the operation of forming and retaining its state of being wound in a bundle and mechanical binding of a material to be bound, there is materialized a smooth drawing-out from the wound state.

SUMMARY OF THE INVENTION

The present invention relates to a ribbon-shaped nonmetallic twist tie having a core part and a wing part constituted from a non-halogenous material which is characterized in that total width is 1.5 to 20.0 mm, the maximum thickness of the wing part is 0.02 to 0.20 mm and the maximum thickness of the core part is 0.04- to 0.30-fold of the total width.

In a preferred embodiment of the nonmetallic twist tie of the present invention, it has a binding property where a torsion strength is 5.0 to 15 N, a rigidity where a tensile elasticity is 5,000 to 30,000 Mpa, a property of forming a fixed shape where the property is 90% or more, a property of retaining a fixed shape where the rate of retaining the fixed shape is 70 to 95%, a drawing-out property where a degree of curving to the drawing-out direction is 10° or less and a winding property where curl radius to the winding direction retains the range of 50 to 200 mm.

BRIEF DESCRIPTION OF THE DRAWING

The present invention will now be illustrated on the basis of the following drawings although those drawings are used for the illustration only and do not limit the present invention at all.

DESCRIPTION OF THE INVENTION

Figure 1:
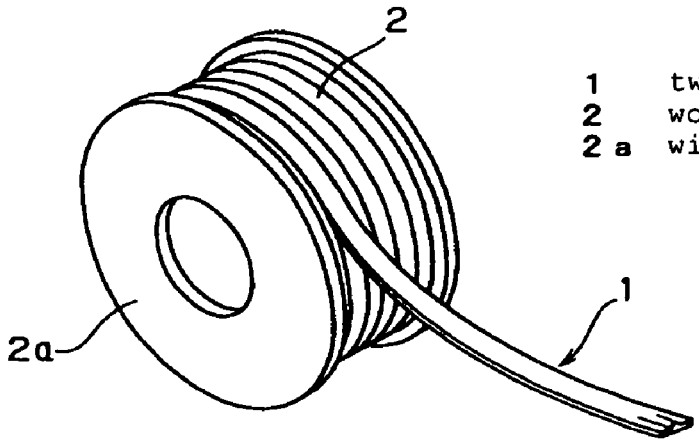
FIG. 1 is an oblique view showing an example of a nonmetallic twist tie of the present invention which is wound in a long size in a bundle form.
Figure 2:
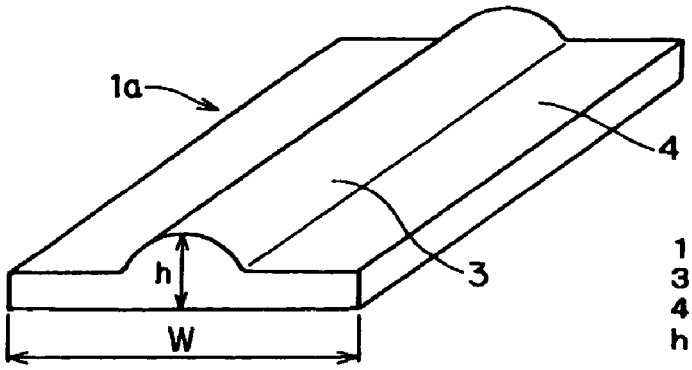
FIG. 2 is an oblique view showing an example of a nonmetallic twist tie of the present invention which is prepared by an extrusion molding.
Figure 3:
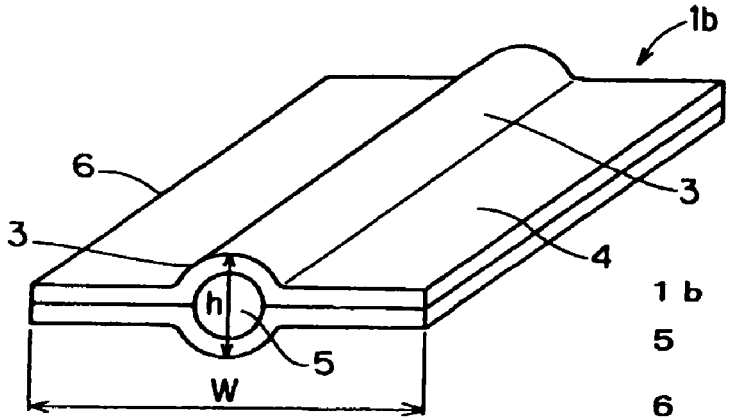
FIG. 3 is an oblique view showing an example of a nonmetallic twist tie of the present invention which is prepared by a lamination molding.

Generally, the nonmetallic twist tie 1 of the present invention takes a form of nonmetallic twist tie 1*a* in an extrusion molding type as shown in FIG. 2 or takes a form of nonmetallic twist tie 1*b* in a lamination type as shown in FIG. 3. The former tie 1*a* is able to be prepared, for example, by extrusion of a compounded composition where a non-halogenous resin is a main component into a shape having core part 3 and wing part 4 to conduct an extrusion integral molding while the latter tie 1*b* is able to be prepared, for example, by making a non-halogenous plastic core line 5 intrinsic in core part 3 and by layering, on upside and downside thereof, a coating material 6 of a plastic film constituted from a non-halogenous resin or a coating material 6 such as paper or nonwoven fabric where said film is laminated in the inner surface thereof to conduct a lamination molding. Those nonmetallic twist ties 1*a*/1*b* are supplied in a state as shown in FIG. 1 where they are wound in a long size in a bundle form on a winding jig (reel).

Figure 4:
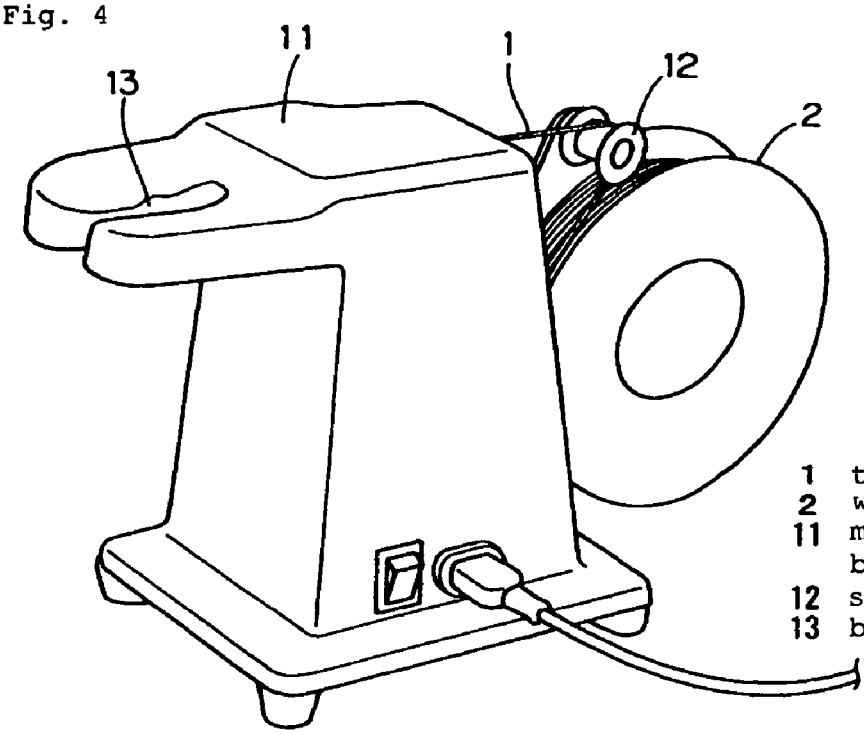
FIG. 4 is an oblique view showing an example of a binding machine in which the nonmetallic twist tie of the present invention is used.
Figure 5:
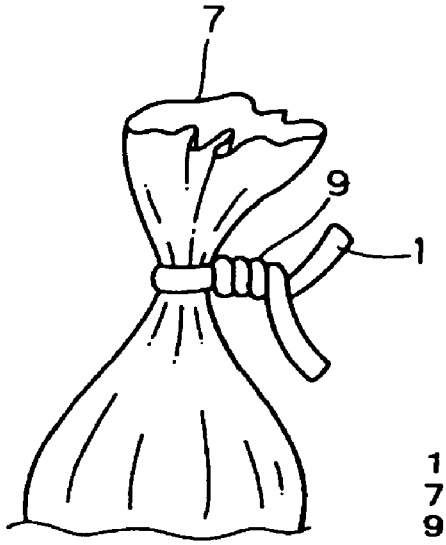
FIG. 5 is a drawing for an example of use of the nonmetallic twist tie of the present invention where a torsion property is shown.
Figure 6:
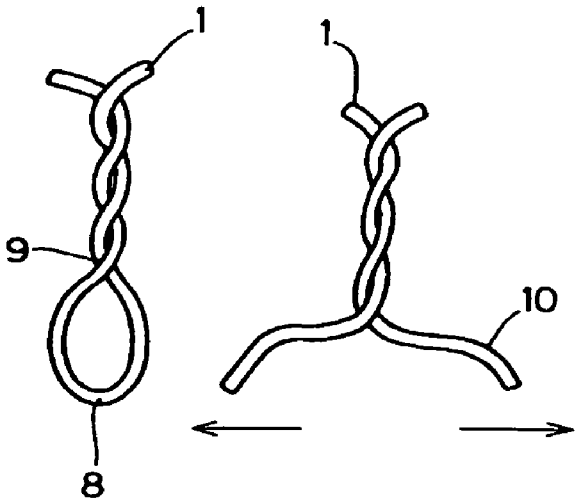
FIG. 6 is a rough drawing of a method for the measurement when a torsion strength (binding force) of the nonmetallic twist tie of the present invention is measured.

The nonmetallic twist tie 1 of the present invention is applied, for example, to a binding machine 11 as shown in FIG. 4 whereby the use in a wound state 2 of as long as, for example, about 500 m to 5,000 m is made possible although there is no particular limitation for the length. For such a purpose, it goes without saying that the binding ability upon binding by a binding machine 11 such as a torsion strength (expressed by a binding force measured by a method as shown in FIG. 6) in a torsion state as shown, for example, in FIG. 5 is to be excellent and, moreover, in a wound shape 2 such as winding on a reel, occurrences of slipping down of the tie 1 into gap of a reel 2*a*, torsion and curl of the tie 1, twining and tangling of ties 1 or loosening or disjoining of tie 1 from the reel 2*a* is not preferred and they should have been solved.

When a nonmetallic twist tie 1 is wound in a bundle form such a wound around a reel or the like, the phenomena such as slipping down of the bound tie 1 into gap of a reel 2*a*, torsion and curl of the tie itself, twining and tangling of ties 1 or loosening or disjoining of tie 1 from the reel 2*a* are apt to happen upon winding, transportation and use.

As a result, when slipping down of the twist tie 1 into gap of a reel, torsion thereof, or twining and tangling of the twist ties 1 happens for example, an unequal resistance is resulted in the twist tie 1 upon drawing out from a wound state 2 whereby there is resulted an inconvenience such as curving of the twist tie to left or to right.

Further, curl of the twist tie 1 results in a curl in the winding direction of the reel 2*a* causing a binding mistake.

On the other hand, disjoining and loosening of the twist tie 1 in a wound shape 2 due to poor property of forming a fixed shape and poor property of retaining a fixed shape of the twist tie 1 are the causes for difficulty in twist in the binding using a binding machine or for breakage of the wing.

The present inventors have intensively carried out studies for solving those problems and, as a result, they have found that, when curving degree a upon drawing-out of the twist tie 1 and curl radius r to a winding direction are controlled within a predetermined range, a good state of drawing out causing no induction of binding mistake is able to be achieved.

Figure 8:
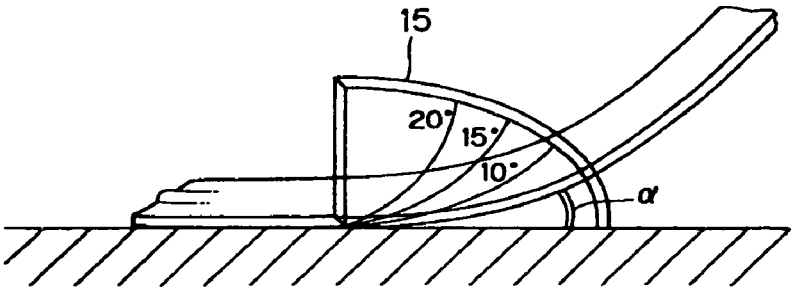
FIG. 8 is a rough drawing of a method for the measurement of a degree of curving to the drawing-out direction when the nonmetallic twist tie of the present invention is drawn out from a wound shape.

Thus, as shown in FIG. 8, it is necessary that a curving degree a to left and to right against the drawing-out direction is kept within 10°. The reason is that, when the curving degree is more than 10°, it often happens that the tie is not well held by a binding machine 11 resulting in a binding mistake.

It is also necessary that a curl radius r to the winding direction is to be within a range of 50 to 200 mm. The reasons is that there are many cases that, when it is more than 200 mm, an upward curvature occurs and a continuous binding by a binding machine 11 is difficult while, when it is less than 50 mm, a downward curvature occurs resulting in troubles for a continuous binding by a binding machine 11.

On the other hand, when difficulty in twist in the binding using a binding machine 11 and breakage of the wing were investigated, frequency for finding such inconveniences was very low in the twist tie 1 where a torsion strength (i.e. a binding force) was within a range of 5 to 15 N.

On the basis of the findings of the studies as such, the present inventors have further investigated the shape of a bound tie 1 where falling down of a twist tie 1 in a wound form 2 into a gap of a reel 2*a*, torsion thereof and twining and tangling of ties 1 hardly take place.

The result was that, in a twist tie 1 where falling down, torsion, twining and tangling hardly occur, its total width (w in FIG. 2 and FIG. 3) is within a range of 1.50 to 20.0 mm and, more preferably, 2.5 to 20.0 mm.

When the total width w is narrower than 1.50 mm, function of the wing part 4 of the twist tie 1 was hardly achieved and frequency of dropping, torsion, twining and tangling increased. When it is wider than 20 mm, width of the wing part 4 also expanded and there were many cases of causing troubles for torsion binding of the twist tie 1.

When the thickness of the wing part 4 was investigated, the maximum thickness of the wing part 4 was appropriate to be 0.02 to 0.2 mm and, more preferably, 0.03 to 0.2 mm.

When thickness of the wing part 4 was thinner than 0.02 mm, the effect as the wing part 4 was hardly achieved and, for example, falling into a gap of the reel 2*a* by oscillation took place. When it was thicker than 0.2 mm, there was a problem such a breakage of the wing upon binding.

Then the core part 3 was investigated and the maximum thickness h of the core part 3 was found to be taken into consideration with regard to the total width w.

Thus, in view of stability and of easy binding of the twist tie 1 upon making into a wound shape 2, it was found to be necessary that the maximum thickness h (height) of the core part 3 was to be made thick when the width w became big while, when the width w became narrow, it was to be made thin.

As a result of further investigation about that, it was found that both winding property and binding property were satisfied to the best extent when the maximum thickness h of the core part 3 was 0.04- to 0.30-fold or, more preferably, 0.05- to 0.25-fold of the total width w of the twist tie 1.

When the maximum thickness h of the core part 3 was less than 0.04-fold to the total width w, the shape was nearly in plate and a stable state was available in winding while, in view of binding, fulcrum for the torsion became wide whereby it was hardly twisted and poor binding was apt to be resulted.

On the other hand, when the maximum thickness h was more than 0.3-fold to the total width w, although that was good in terms of a good binding, state of the wound shape 2 became unstable because the core part 3 was projected in winding and, as a result, the twist tie 1 was apt to slip during winding whereby there was a possibility of resulting in falling into the gap and twining and tangling of ties 1.

Although it is possible to make the shape of the core part 3 into convex on one side as shown in FIG. 2 particularly in view of consideration in the wound shape 2, there is no necessity to insist on that shape but the conclusion is that it is acceptable to have a thickness h in 0.04- to 0.3-fold to the total width w.

Then the present inventors investigated a phenomenon where disjoining and loosening are apt to occur in a bound tie 1 in a wound shape 2. As a result, it was found that, in order not to cause disjoining and loosening, it is necessary to give 90% or more property of forming a fixed shape and 70 to 95% of property of retaining a fixed shape to the bound tie 1.

Further, when an investigation was conducted for a torsion strength in order not to cause a binding mistake in binding, the twist tie 1 having a binding property (torsion strength) of 5 to 15 N showed the least binding mistake.

The property of forming a fixed shape, property of retaining a fixed shape and binding property within the aforementioned numeral range were achieved in a twist tie 1 where a tensile elasticity was 5,000 to 30,000 Mpa.

The tensile elasticity is able to be obtained by any of the followings. They are (1) the use of a plastic core material 5 (FIG. 3) which is highly elongated to an extent of 10-fold or more and (b) an extrusion molding of a compounded substance to which a filler is added followed by subjecting to an elongation of 2.5-fold or more (FIG. 2).

With regard to a torsion strength (binding force), the preferred one in a mechanical binding was 5 to 15 N. In other words, when the torsion strength (binding force) was less than 5 N, there was a binding mistake such as a loosening immediately after binding in a mechanical binding. In the case of more than 15 N where a strong load was applied upon the torsion, load was applied to a machine whereby an undesired binding state was noted such as that the bound part was in a shape of being bunched up together.

In addition, when the torsion strength (biding force) was less than 5 N, there was a problem in a function as a twist tie 1 such as a slipping off from a thing to be bound 7 or a disjointing by a mere weak force. In the case of more than 15 N, although there as no problem in a binding force, disjointing was poor as a result of too tight binding whereby there was a disadvantage of difficulty in recycling.

Now, property of retaining a fixed shape will be illustrated. When the property of retaining a fixed shape was less than 70%, there were many cases where disjoining of the tie 1 from the reel 2*a* was induced while, when it was more than 95%, the recovering force is poor whereby frequency of slipping down into the gap and tangling and twining of the lines was much.

In a twist tie 1 where the property of forming a fixed shape was less than 90%, it was hardly aligned with the reel 2*a* or the like in winding and, in addition, repulsive property of the tie 1 itself was big whereby falling into the reel 2*a* or tangling or twining is resulted.

Now, materials of the twist tie of the present invention will be illustrated by dividing into a nonmetallic twist tie 1*a* of an extrusion molding type as shown in FIG. 2 (hereinafter, referred to as an extrusion tie) and a nonmetallic twist tie 1*b* of a lamination molding type as shown in FIG. 3 (hereinafter, referred to as a lamination tie).

An extrusion tie 1*a* comprises a compounded composition where a non-halogenous thermoplastic resin is a main component and, with regard to the thermoplastic resin, there is used one member selected from the group consisting of a polyester resin such as polyethylene terephthalate and polybutylene terephthalate, a polyamide resin such as Nylon 6 and Nylon 66, a polyacetal resin such as polyvinyl formal and polyvinyl butyral, a polyolefin resin such as polyethylene and polypropylene, an acetate resin such as acetylcellulose, a polyvinyl resin such as Vinylon, starch, a biodegradable resin such as polylactic acid, a regenerated cellulose resin such as rayon, an acrylate resin such as polyacrylonitrile and a copolymer of polyacrylonitrile with acrylate monomer, a polycarbonate resin, a polyphenylene sulfide resin, etc. or a mixture of two or more members thereof.

In addition to the aforementioned thermoplastic resin, the extrusion tie 1*a* is composed of a compounded substance in which silicic acid represented by white carbon, aluminum silicate represented by clay, magnesium silicate represented by talc, a silicate represented by silicic acid compound such as mica powder, a carbonate represented by calcium carbonate and magnesium carbonate, a metal oxide represented by calcium oxide, magnesium oxide, zinc oxide and titanium oxide, a metal hydroxide represented by magnesium hydroxide and aluminum hydroxide, a filler such as barium sulfate and carbon black, a lubricant such as stearic acid and zinc stearate, a plasticizers of a trimellitate type, a phthalate type, a fumarate type, an adipate type, an azelate type, a sebacate type, a polyester type and a stearate type, pigment, etc. are appropriately selected and added thereto upon necessity.

In view of a shape, there is a difference in the thickness between the core part 3 and the wing part 4 and the reason therefor is that, due to the difference in the thickness, rigidity is given to the core part 3 while flexibility is given to the wing part 4. In FIG. 2, the shape of the core part 3 is shown in a convex on one side but it goes without saying that the shape of the core part 3 is not limited thereto but it may be in convexes on both sides and what is important is that there is a predetermined difference between the thickness of the core part 3 and that of the wing part 4. In the attached drawings, the core part 3 is located nearly at the central part but the position is not always limited to the central part but may be at the end. The number thereof is not also limited to one but each one may be formed on both ends or plural ones may be formed at desired places.

Further, in the extrusion tie la, it is also possible for further enhancing the rigidity of the core part 3 that the core part 3 and the wing part 4 are made in different compoundings and an extrusion molding is conducted using a biaxial extruder.

On the other hand, the lamination tie 1*b* has a constitution where a plastic core material 5 comprising a non-halogenous resin being easily subjected to a plastic deformation is inserted between two sheets of coating materials 6 acting as a wing part and comprising paper, nonwoven fabric or the like where a thermoplastic resin such as plastic film or PE comprising a non-halogenous resin is laminated in the inner surface thereof. With regard to the plastic film comprising non-halogenous resin, an olefin film such as PE and PP, a polyolefin terephthalate film such as PET and PBT, an acetate film or a film comprising layered product thereof or a film using the above as a base on which metal is vapor-deposited having a thickness of 10 to 100 μ is mostly used although they are non-limitative but anything which is able to retain a property as a wing part may be used. Two coating materials which are laminated may be same or they may be different such as paper and PET film.

With regard to the core material 5, a preferably used one is fine plastic lines comprising non-halogenous resin which is easily able to be subjected to a plastic deformation having a diameter of 0.3 to 1.8 mm, being highly elongated to an extent of 10-fold or more and mainly comprising a polyolefin resin such as polyethylene and polypropylene, a polyolefin terephthalate resin such as polybutylene terephthalate and polyethylene terephthalate, a polyamide resin or the like.

The twist tie 1 of the present invention which is prepared as such is able to be bound using a binding machine 11 as shown in FIG. 4 for example. In the binding machine 11 of FIG. 4, an open part of a bag-shaped thing to be bound as shown in FIG. 5 for example is inserted into a binding groove 13 of the main body of the binding machine 11 whereupon a continuous binding is conducted. In the twist tie 1 of the present invention, it has a property necessary for the binding and its drawing out from the wound shape 2 is stabilized and, therefore, even in an operation with a speed of as high as 50 to 100 times per minute, a binding mistake is able to be suppressed to a minimum extent.

The twist tie 1 of the present invention is used in a wound form as mentioned above and, besides that, it is also possible to use for a hand twisting for the use in gardening in such a form that the tie is drawn out from the wound form and cut in a predetermined length. In the case of a previously cut product which is produced for the use of hand twisting, a slitting operation or a cutting operation from big winding, medium winding or small winding is able to be smoothly carried during the step thereof because of the aforementioned good winding property and drawing-out property whereby it is possible to afford a cut product having a beautiful finish and a low production cost.

EXAMPLES

Method for the Measurement of Torsion Strength (Binding Force)

As shown in FIG. 6, a loop part 8 of the twist tie 1 after pulling out from the thing to be bound 7 is cut at the position opposite to the bound part 9 and used as a sample.

In the measurement, the loop ends formed by cutting are set on the upper and lower fasteners of the tensile tester and pulled at the rate of 300 mm/minute to measure a binding force.

Method for the Calculation of Property of Forming a Fixed Shape and Property of Retaining a Fixed Shape Property of forming a fixed shape and property of retaining a fixed shape (retaining state to a wound form) are calculated d by the following formulae.

Property of Forming a Fixed Shape (Easiness in Bending)

$$B(\%)=\{(l_0-l_1)/(l_0)\}\times 100$$

Property of Retaining a Fixed Shape (Easiness in Rounding)

$$R(\%)=\{1-(l_3-l_2)/(l_3)\}\times 100$$

l: Distance between the Marked Lines $l_0$: Straight-Line Distance between the Marked Lines upon Non-Loading (Measured Thickness of the Dial Gauge upon Non-Loading−Thickness of Sample×2)

$l_1$: Straight-Line Distance between the Marked Lines upon Loading (Measured Thickness of the Dial Gauge upon Loading−Thickness of Sample×2)

Figure 7:
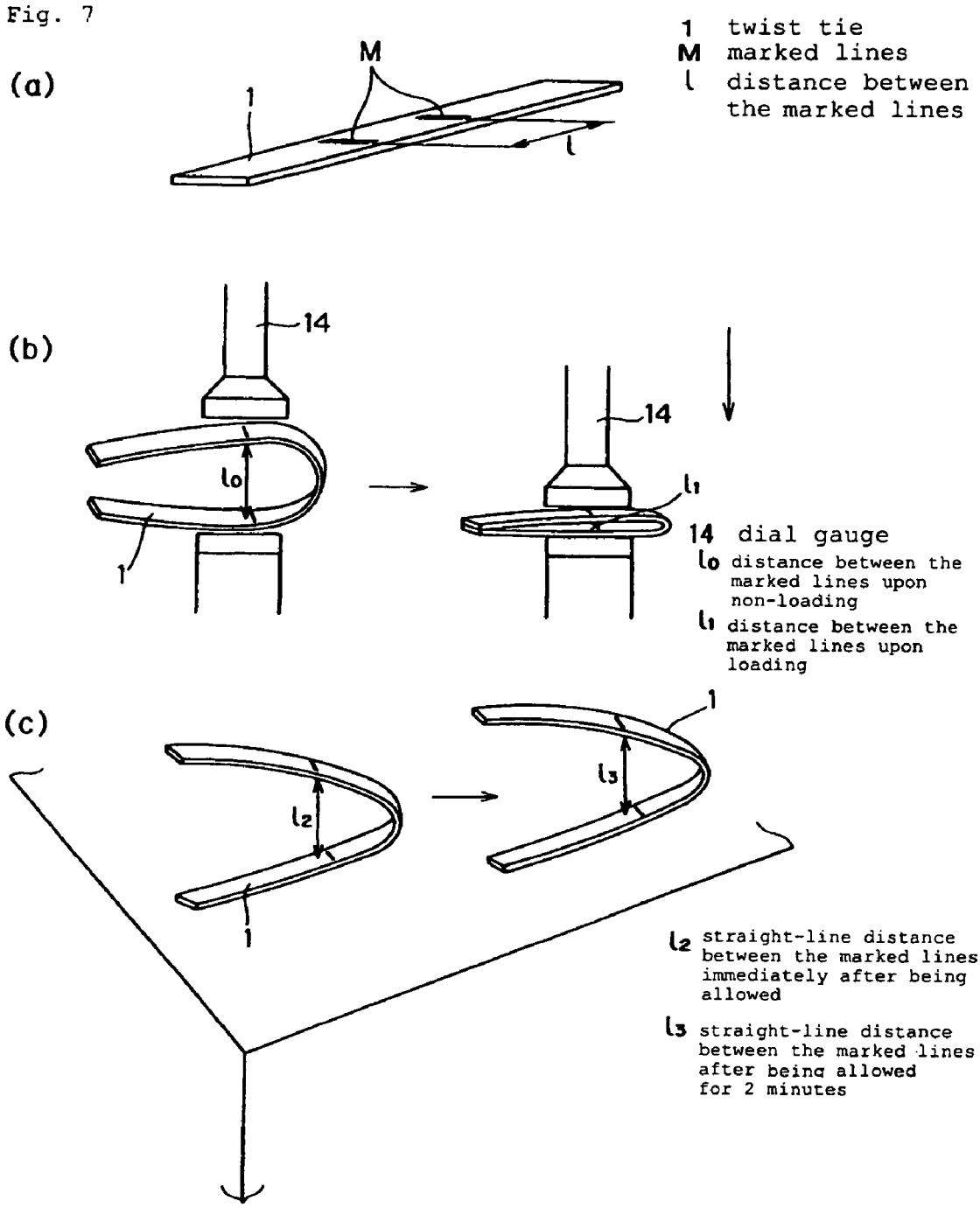
FIG. 7 is a rough drawing of a method for the measurement when a property of forming a fixed shape and a property of retaining a fixed shape of the nonmetallic twist tie of the present invention are measured.

$l_2$: Straight-Line Distance between the Marked Lines Immediately after Being Allowed $l_3$: Straight-Line Distance between the Marked Lines after Being Allowed for 2 Minutes Method for the Measurement of Property of Forming a Fixed Shape and Property of Retaining a Fixed Shape As shown in FIG. 7, (1) a twist tie 1 collected from a wound form in a bundle is cut in a length of 80 mm precisely to prepare a sample and marked lines M having a predetermined distance 1 between the lines are formed at the central position of the sample (FIG. 7*a*), (2) the sample is mildly bent so as to align the ends, the site of the marked lines M is sandwiched with a dial gauge 14 having a measuring load of 80 g as stipulated by JIS Z 0237 (JIS B 7503), a straight-line distance between the marked lines upon non-loading ($l_0$) and a straight-line distance between the marked lines upon loading ($l_1$) are read from the graduation of the dial gauge 14 and a property of forming a fixed shape is determined from the aforementioned formula (FIG. 7*b*) and then (3) the dial gauge 14 is removed, the straight-line distance between the marked lines immediately after being allowed ($l_2$) is measured by a carpenter's square followed by measuring the straight-line distance between the marked lines after 2 minutes ($l_3$) and a property of retaining the fixed shape is measured by the aforementioned formula (FIG. 7*c*).

Method for the Measurement of Degree of Curving

As shown in FIG. 8, degree of curving to the drawing-out direction of the twist tie 1 when the twist tie 1 in a wound state in a bundle is measured. Thus, the tie 1 is drawn out from a the wound state in a bundle to an extent of about 20 cm length and a thick paper 15 for the measurement of degree of curving is attached as shown in the drawing and aligned to any of lines shown on the thick paper 15 to measure the degree of curving of the tie drawing out from the wound state in a bundle.

Method for the Measurement of Curl Radius

Figure 9:
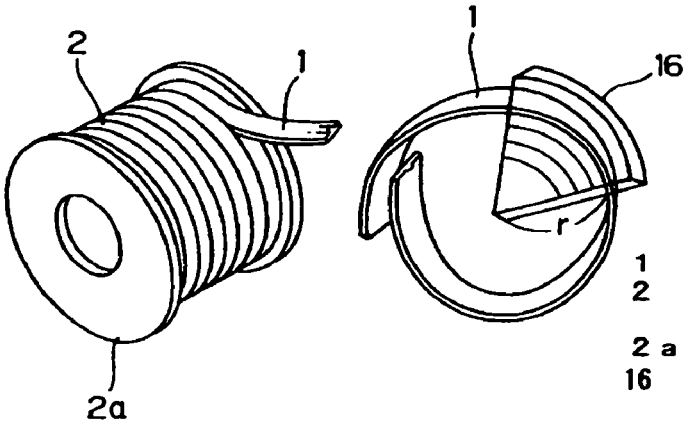
FIG. 9 is a rough drawing of a method for the measurement of curling radius to the wound direction when the nonmetallic twist tie of the present invention is drawn out from a wound shape.

With regard to the measurement of the curl radius, a curl radius r to the wound direction is measured as shown in FIG. 9. Thus, a length corresponding to one round is mildly rewind from a wound state in a bundle and then cut. A previously prepared thick paper 16 having arcs for the measurement of curl radius is used, the surrounding of the sample is aligned to the corresponding arc of the thick paper 16 and the radius r to the arc is defined as the radius 5 of the curl.

Example 1

Extrusion was carried out using the composition mentioned in the compounding example for the extrusion tie as shown in Table 1 followed by subjecting to an elongation for 3-fold to prepare a twist tie having the shape as shown in FIG. 2. This was wound in about 1,000 m in a form of a bundle to prepare extrusion tie samples A-1 to A-6. Results of measurement for size, shape and property of the samples are as shown in Table 3. Each sample was subjected to a binding machine and subjected to a practical test and the results thereof are as shown in Table 4.

Example 2

For each of the PE core lines (a to e) mentioned in Table 2, plural core lines were laminated using the coating material mentioned in the same Table 2 in such a manner that they were made to reside in the coating material in parallel and, after that, the product was slit in each width to prepare a lamination tie having a shape as shown in FIG. 3. This was then wound in about 1,000 min a form of a bundle to prepare lamination tie samples B-1 to B-5. Results of measurement for size, shape and property of the samples are as shown in Table 3. Each sample was subjected to a binding machine and then to a practical test and the results thereof are as shown in Table 4.

TABLE 1

Compounding Example of Extrusion Tie

| Compounded Composition | Compounded Amount (part(s) by weight) | Name of Manufacturing Company |
|---|---|---|
| Polyethylene terephthalate (SA-1206) | 90 | Unitika |
| Polyethylene resin (NUC, grade G) | 10 | Nippon Unicar |
| Zinc stearate | 0.1 | Sakai Chemical Industry |
| Barium sulfate | 10 | Sakai Chemical Industry |
| Softener (Adekapol CLE-1000) | 0.05 | Asahi Denka |
| Pigment (BMF-270, PBF-650-S) | 0.1 | Resino Color Industry |

TABLE 2

Material Used for Lamination Tie

| Material Used | Constitution | Thickness (μm) | Width (mm) | Name of Manufacturing Company |
|---|---|---|---|---|
| Polyethylene-laminated PET film | PET film<br>Polyethylene-laminated film | 20<br>20 | 300 | Meiwa Pax |
| Polyethylene-laminated paper | Paper<br>Polyethylene-laminated film | 20<br>20 | 300 | |

| Material Used | | Average Line Diameter (mm) | Deniers | Name of Manufacturing Company |
|---|---|---|---|---|
| Fine line of strongly-elongated polyethylene | PE core a | 0.67 | 3000 | Mitsui Chemical Industry |
| | PE core b | 0.70 | 3300 | |
| | PE core c | 0.73 | 3600 | |
| | PE core d | 0.78 | 4000 | |
| | PE core e | 0.86 | 5000 | |

TABLE 3

(Part 1) Results of Size/Shape and Properties

| Measured Items and Units | | Type and Sample Numbers Extrusion Tie | | | | | | |
|---|---|---|---|---|---|---|---|---|
| | | A-1 | A-2 | A-3 | A-4 | A-5 | A-6 | Ref. 1* |
| Size/Shape | | | | | | | | |
| Total width | mm | 1.40 | 3.75 | 4.00 | 3.75 | 3.75 | 1.5 | 3.82 |
| Average thickness of wing part | mm | 0.10 | 0.05 | 0.12 | 0.10 | 0.10 | 0.10 | 0.10 |
| Core line | — | absent | absent | absent | absent | absent | absent | present** |
| Maximum thickness of core part | mm | 0.40 | 0.10 | 0.85 | 1.00 | 1.10 | 0.46 | 0.7 |
| (Rate of thickness to total width) | | (0.286) | (0.026) | (0.213) | (0.29) | (0.293) | (0.31) | (0.183) |
| Properties | | | | | | | | |
| Torsion strength (binding force) | N/3 twists | 7.6 | 12.2 | 10.4 | 11.5 | 8.0 | 7.5 | 30 |
| Average tensile elasticity | Mpa | 5150 | 5490 | 5410 | 5250 | 5350 | 5020 | 30000 |
| Degree of curving | | <8° | <5° | <5° | <5° | <5° | <9° | <5° |
| Curl radius | mm | 95 | 100 | 95 | 100 | 95 | 120 | 95 |
| Property of forming a shape | % | 95 | 96 | 92 | 93 | 95 | 93 | 93 |
| Property of retaining a shape | % | 55 | 60 | 85 | 75 | 73 | 65 | 90 |

*Comparative Example A
**iron core: 0.47 mm (Part 2) Results of Size/Shape and Properties

| Measured Items and Units | | Type and Sample Numbers Lamination Tie | | | | | |
|---|---|---|---|---|---|---|---|
| | | B-1 | B-2 | B-3 | B-4 | B-5 | Ref. 2* |
| Size/Shape | | | | | | | |
| Total width | mm | 2.5 | 5.0 | 10 | 15 | 20 | 5.0 |
| Average thickness of wing part | mm | 0.08 | 0.08 | 0.08 | 0.08 | 0.08 | 0.08 |
| Core line | — | present** | present*** | present**** | present***** | present****** | present******* |
| Maximum thickness of core part | mm | 0.78 | 0.78 | 0.81 | 0.86 | 0.94 | 0.61 |
| (Rate of thickness to total width) | | (0.312) | (0.156) | (0.08) | (0.057) | (0.047) | (0.122) |
| Properties | | | | | | | |
| Torsion strength (binding force) | N/3 twists | 7.1 | 6.5 | 6.0 | 5.8 | 5.3 | 4.3 |
| Average tensile elasticity | Mpa | 13300 | 13350 | 13800 | 13500 | 13450 | 4350 |
| Degree of curving | | <8° | <5° | <5° | <5° | <5° | <5° |
| Curl radius | mm | 120 | 145 | 115 | 120 | 130 | 110 |
| Property of forming a shape | % | 95 | 92 | 95 | 93 | 92 | 85 |
| Property of retaining a shape | % | 65 | 72 | 71 | 71 | 72 | 40 |

*Comparative Example B
**PE core: a
***PE core: b
****PE core: c
*****PE core: d
******PE core: e
*******PET core: 0.55 mm

TABLE 4

(Part 1) Practical Test (5,000 shots)

| Measured Items and Units | | Type and Sample Numbers Extrusion Tie | | | | | | |
|---|---|---|---|---|---|---|---|---|
| | | A-1 | A-2 | A-3 | A-4 | A-5 | A-6 | Ref. 1* |
| Stop caused by wound state in a bundle | | | | | | | | |
| Stop caused by slipping down into gap | times | 48 | 12 | 0 | 0 | 0 | 58 | 22 |
| Stop caused by torsion and curl of tie | times | 9 | 7 | 0 | 0 | 0 | 0 | 0 |
| Stop caused by twining and tangling of ties | times | 33 | 0 | 0 | 0 | 0 | 0 | 27 |
| Stop caused by loosening and disjoining | times | 0 | 0 | 0 | 0 | 0 | 0 | 0 |
| Total numbers of stops | times | 90 | 19 | 0 | 0 | 0 | 58 | 49 |
| Evaluation on shape-retaining state | — | x | ○ | ○ | ○ | ○ | x | x |

TABLE 4-continued

| | | | | | | | | |
|---|---|---|---|---|---|---|---|---|
| Properties | | | | | | | | |
| Drawing-out property of tie | by naked eye | x | ○ | ○ | ○ | ○ | x | ○ |
| Binding mistake | times | 73 | 115 | 0 | 0 | 0 | 98 | 0 |
| Projection of core line at ends | times | none | none | none | none | none | none | 54 |
| Evaluation of binding property | — | x | x | ○ | ○ | ○ | x | x |
| Total evaluation | — | x | x | ○ | ○ | ○ | x | x |

*Comparative Example A
Evaluations (○: excellent; Δ: good; x: no good)

(Part 2) Practical Test (5,000 shots)

| Measured Items and Units | | Type and Sample Numbers Lamination Tie | | | | | |
|---|---|---|---|---|---|---|---|
| | | B-1 | B-2 | B-3 | B-4 | B-5 | Ref. 1* |
| Stop caused by wound state in a bundle | | | | | | | |
| Stop caused by slipping down into gap | times | 45 | 0 | 0 | 0 | 0 | 8 |
| Stop caused by torsion and curl of tie | times | 0 | 0 | 0 | 0 | 0 | 0 |
| Stop caused by twining and tangling of ties | times | 8 | 0 | 0 | 0 | 0 | 0 |
| Stop caused by loosening and disjoining | times | 0 | 0 | 0 | 0 | 0 | 25 |
| Total numbers of stops | times | 53 | 0 | 0 | 0 | 0 | 33 |
| Evaluation on shape-retaining state | — | x | ○ | ○ | ○ | ○ | Δ |
| Properties | | | | | | | |
| Drawing-out property of tie | by naked eye | ○ | ○ | ○ | ○ | ○ | ○ |
| Binding mistake | times | 83 | 0 | 0 | 0 | 0 | 78 |
| Projection of core line at ends | times | 0 | 0 | 0 | 0 | 0 | 8 |
| Evaluation of binding property | — | x | ○ | ○ | ○ | ○ | x |
| Total evaluation | — | x | ○ | ○ | ○ | ○ | x |

*Comparative Example B
Evaluations (○: excellent; Δ: good; x: no good)

As noted from Table 3 and Table 4, the nonmetallic twist tie of the present invention has shape and property by which the necessary function inherent to a twist tie was able to be fully achieved. In addition, in its wound state in a bundle, it was noted to be able to give and retain a shape by which slipping down into a gap of a winding reel, torsion and curl of the tie itself, twining and tangling of ties and loosening or disjoining in a wound state were very rare. Moreover, drawing out upon binding a material to be bound and the binding property at that time were also well satisfactory.

MERIT OF THE INVENTION

The nonmetallic twist tie of the present invention has the aforementioned constitution and, accordingly, it is able to achieve the following advantages.

(1) When the tie is wound in a bundle form, slipping down into a gap of a reel, torsion and curl of the tie itself, twining and tangling of ties and loosening or disjoining from a wound state were rare and a smooth drawing out is able to be carried out.

(2) The tie has all of properties which are necessary for a mechanical binding and mistake in a mechanical binding is very rare.

(3) Safety in actual use is very high in such a respect that, for example, no metal wire is used.

(4) The tie is constituted from a non-halogenous material and it is a product taking a due considering in "environment".

(5) The tie is able to be developed to broad areas from a long-size winding for a mechanical winding to a cut product for a hand binding.

The invention claimed is:

1. A ribbon-shaped nonmetallic twist tie having a core part and a wing part constituted from a non-halogenous material, characterized in that the core part and wing part each extend the length of the tie, the tie having a total width of 1.5 to 20.0 mm, a maximum thickness of the wing part of 0.02 to 0.20 mm, a maximum thickness of the core part of 0.04- to 0.30-fold of the total width, and a property of retaining a fixed shape of 95% or less, where the property of retaining a fixed shape is determined by:

preparing a sample tie having two ends and a length of 80 mm;

marking lines M a predetermined distance apart at the central portion of the sample tie;

bending the sample tie to align the ends of the sample tie and to align the marked lines M;

applying 80 g of load at the marked lines M;

removing the load;

determining a straight line distance $l_2$ between the marked lines M immediately after removing the load;

determining a straight line distance $l_3$ between the marked lines M two minutes after removing the load; and determining the property of retaining a fixed shape R, where $$R=\{1-(l_3-l_2)/(l_3)\}\times 100.$$

2. The nonmetallic twist tie according to claim 1, characterized in having a torsion strength of 5 to 15 N.

3. The nonmetallic twist tie according to claim 1, characterized in having a tensile elasticity of 5000 to 30,000 Mpa.

4. The nonmetallic twist tie according to claim 1, characterized in having a property of forming a fixed shape of 90% or more and a property of retaining a fixed shape of 70 to 95%, where the property of forming a fixed shape is determined by:

preparing a sample tie having two ends and a length of 80 mm;

marking lines M a predetermined distance apart at the central portion of the sample tie;

bending the sample tie to align the ends of the sample tie and to align the marked lines M;

determining a straight-line distance $l_0$ between the marked lines;

applying 80 g of load at the marked lines M;

determining a straight-line distance $l_1$ between the marked lines upon loading; and determining a property of forming a fixed shape B, where $$B=\{(l_0-l_1)/(l_0)\}\times 100.$$

5. The nonmetallic twist tie according to any one of claims 1-4, characterized in having a drawing-out property where a degree of curving to the drawing-out direction is 10° or less and a curl radius to the winding direction retains the range of 50 to 200 mm.

* * * * *